United States Patent [19]

Dillarstone et al.

[11] 4,214,915

[45] Jul. 29, 1980

[54] METHOD AND COMPOSITION FOR CLEANING OVENS

[75] Inventors: Alan Dillarstone, Bramhall; Norman C. Lowe, Flixton; Edwin Cropper, Shaw, all of England

[73] Assignee: Colgate-Palmolive Company, New York, N.Y.

[21] Appl. No.: 931,783

[22] Filed: Aug. 7, 1978

Related U.S. Application Data

[63] Continuation of Ser. No. 745,753, Nov. 29, 1976, abandoned.

[51] Int. Cl.[2] ..... B08B 3/08; B08B 3/10

[52] U.S. Cl. ..... 134/19; 134/22 R; 134/40; 252/156

[58] Field of Search ..... 134/2, 19, 22 R, 40; 252/156, 158, 159, 160, DIG. 7

[56] References Cited

U.S. PATENT DOCUMENTS

| | | | |
|---|---|---|---|
| 3,031,408 | 4/1962 | Perlman et al. | 134/40 UX |
| 3,658,711 | 4/1972 | Mukai et al. | 252/156 X |
| 3,684,576 | 8/1972 | Eisen et al. | 252/156 X |
| 3,827,983 | 8/1974 | Mitchell et al. | 134/40 X |

FOREIGN PATENT DOCUMENTS 1284770 8/1972 United Kingdom .

*Primary Examiner*—Marc L. Caroff
*Attorney, Agent, or Firm*—Norman Blumenkopf; Herbert S. Sylvester; Murray M. Grill

[57] ABSTRACT

The oven cleaner composition includes from 1 to 2% by weight sodium bicarbonate and from 14 to 17% by weight potassium bicarbonate in an aqueous solution in which the weight ratio of sodium bicarbonate to potassium bicarbonate is from 1:7 to 1:17. The composition can be applied to the surface before and/or after soiling.

11 Claims, No Drawings

METHOD AND COMPOSITION FOR CLEANING OVENS

This is a continuation of application Ser. No. 745,753 filed Nov. 29, 1976, now abandoned.

This invention relates to the cleaning of surfaces, such as the surfaces of ovens, which are subject to heat and are soiled, or liable to soiling, by baked-on organic food deposits. The soiling matter deposited on ovens, such as domestic cooker ovens, consists of a complex organic mixture of natural fats and other deposits from the cooking of food. When heated at normal oven temperatures, this soiling matter is converted into an infusible polymeric mass in which part of the organic material may also be charred.

Detergents, scouring powders and similar cleansing products, even when alkaline (e.g. those containing phosphates), although highly efficient for removing normal greasy soiling matter, are not usually adequate for removing baked-on soil of the type found in ovens.

The removal of this type of soil is therefore a considerable problem, requiring powerful chemical or physical action. Among the most effective chemical compounds known for this purpose are the caustic alkalis, sodium and potassium hydroxide. Their mode of action is that they react with and hydrolyse natural fats, thus converting them at least partially into their sodium or potassium salts, which are water-soluble and thus easily removed. Commercial products of this type usually contain up to 3% of sodium hydroxide together with other components such as solvents and emulsifiers which promote the efficiency of the product. They may be applied direct by brush or sponge, or more conveniently by means of an aerosol spray. Products of this type, although efficient in their action, suffer from a number of major disadvantages. The most important disadvantage is the serious hazard to the eyes and skin arising from the use of caustic alkalis. If inadvertently sprayed in the eyes, a product of this type could cause permanent blindness. It is also common practice for housewives to use rubber gloves when applying a product of this type to avoid damage to the skin. Such products may also damage adjacent surfaces, such as paint, aluminium or wood, onto which they may be inadvertently sprayed. Another disadvantage is that such products when applied to soiled oven surfaces must attack the soiling matter from the outer surface, while the most severe charring and polymerisation is generally present in the interior of the soil layer, adjacent the oven wall. This makes cleaning more difficult.

Alkalis less alkaline than caustic soda, although they would avoid some of the hazards already indicated, are not very effective in hydrolysing baked-on fat in the short time of application, and consequently are not efficient oven cleaners.

Certain pre-treatment preparations are known which act by forming a physical barrier between the oven wall and the soiling matter, and do not depend on chemical actions. Those preparations are expensive and not very effective.

The invention (herein called the main invention) which is the subject of British Pat. No. 1284770 has an object to avoid the disadvantages of the previously known oven cleaner preparations, and at the same time to provide a simple and effective procedure for oven cleaning.

According to one aspect of the main invention, a method of cleaning a surface which is subjected to heat and which is liable to soiling by baked-on organic food deposits comprises applying to the clean surface an alkali metal bicarbonate and washing the surface clean again after such heating and soiling.

According to other aspects of the main invention there are provided various compositions for the pre-treatment of such a surface and comprising an alkali metal bicarbonate, an aqueous vehicle and other components as described in the complete specification of the said Patent.

Examples of suitable alkali metal bicarbonates referred to in patent specification No. 1284770 are sodium bicarbonate, potassium bicarbonate and mixtures thereof, sodium bicarbonate being preferred.

The present invention is an improvement in, or a modification of, the main invention. It is based on the discovery that certain mixtures of sodium bicarbonate and potassium bicarbonate in which the potassium bicarbonate predominates provide a more effective cleaning effect than sodium bicarbonate alone or potassium bicarbonate alone or mixtures in which sodium bicarbonate predominates. The reason why such a mixture of sodium and potassium bicarbonates is more effective than either of the constituents of the mixture is not yet understood. Potassium bicarbonate is several times more soluble in water than sodium bicarbonate, and of the alkali metal soaps of fatty acids which may result from reaction of alkali metal bicarbonates with fatty constituents of the food residues, potassium soaps are softer than sodium soaps. It might therefore be expected that a composition based on potassium bicarbonate would be more effective than a composition based on a mixture of sodium and potassium bicarbonates; but that is not the case.

Further, it has been discovered that compositions containing the synergistic mixtures of the two bicarbonates are effective not only for pre-treatment of a surface which is liable to soiling by baked-on organic food deposits, but is also effective for removing such deposits when the compositions are applied subsequently.

According to one aspect of the present invention, a method of cleaning a surface which is subjected to heat and is soiled, or liable to soiling, by baked-on organic food deposits comprises applying to the surface, before and/or after the deposition of the deposits thereon, a mixture of sodium bicarbonate and potassium bicarbonate in which the potassium carbonate predominates, preferably in a weight ratio from 1:7 to 1:17. The optimum weight ratio is approximately 1:11.

According to another aspect of the invention, a composition for use for the purpose specified comprises an aqueous solution containing a mixture of sodium and potassium bicarbonates in which potassium bicarbonate predominates, preferably from 1 to 2% by weight of sodium bicarbonate and 14 to 17% by weight of potassium bicarbonate.

It is also advantageous to include in the aqueous solution a surfactant, preferably an anionic or nonionic or amphoteric surfactant. Numerous such surfactants are commercially available and many others are known in the art, details of which can be found in the literature; for example, the textbook "Surface Active Agents" by Schwartz and Perry, published by Interscience Publishers, New York, U.S.A., and reference "Detergents and Emulsifiers Annual" by J. W. McCutcheon.

It has been found that a particular amphoteric surfactant substantially enhances the effect of the mixture of sodium and potassium bicarbonates, and accordingly this surfactant is particularly preferred. This surfactant is a imidazoline dicarboxylic derivative of linoleic acid which is commercially available under the trade name "Miranol L2M" (MIRANOL is a trade mark). It is stated to have the formula:

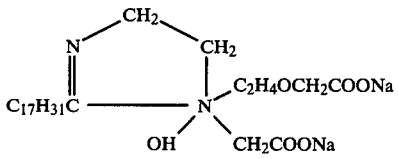

The preferred range of surfactant in the aqueous solution is from 0.25 to 1% by weight, an optimum proportion of the "Miranol L2M" surfactant being 0.5% by weight of a 38% by weight aqueous solution thereof.

The compositions may be prepared in a variety of different forms.

One form is a single aqueous solution. This can be applied in a simple manner, e.g. by spraying, brushing or wiping it on to the soiled or soilable surface. For spray application, the composition may be dispensed by a simple manually operated pump spray device or even a squeeze bottle.

Another form is an aerosol composition dispensable in the form of a spray from a pressurised valved container. The propellant is preferably of the halogenated hydrocarbon type, consisting of a single propellant or a mixture of two or more different propellants selected having regard to their vapour pressures and spraying properties. A suitable propellant is a mixture of the aerosol propellants known as "Propellant 12" and "Propellant 114". A suitable range of proportions is from 87 to 93% by weight of the aqueous solution of the bicarbonates (and surfactant, if any), from 2.8 to 5.2% by weight of "Propellant 12" and from 4.2 to 7.8% by weight of "Propellant 114". It is desirable to include an emulsifying agent in aerosol compositions, in order to emulsify the propellant with the aqueous solution. Nonionic surfactants are suitable for this purpose, for example, ethoxylated fatty alcohols such as that known by the trade designation "Ethylan D252". From 0.1% to 0.3%, e.g. about 0.2%, by weight has been found to be a satisfactory proportion of the emulsifying agent, based on the aqueous solution.

A further form of the composition is a paste or gel in which the aqueous solution of the bicarbonates (and surfactant, if any), is thickened by means of a gelling or thickening agent. Such a paste or gel composition can be applied to the soiled or soilable surface by wiping it on, e.g. from a sponge or other porous pad impregnated with the paste or gel.

When the compositions are applied to already soiled surfaces, it has been observed that some foaming takes place at the surface, the presence of the foam affording a visual indication of the areas of the surface to which the composition has been applied. However, if desired, a visualizing agent such as a dye could be included in the composition to reduce the likelihood of any soilable or soiled areas being missed by the user.

It is permissible to include in the compositions other ingredients such as perfumes. In the case of compositions sold in metal containers, such as aerosol dispensers, corrosion inhibitors such as sodium benzoate or sodium nitrite or mixtures thereof may be added, but as the compositions are only mildly alkaline and are not aggressive to metals, it may not be necessary to include a corrosion inhibitor.

The following Examples illustrate the invention.

EXAMPLE 1. Aerosol

Make an aqueous solution of the following composition:

| Item | % by weight |
|---|---|
| Sodium bicarbonate | 1.4 |
| Potassium bicarbonate | 16.0 |
| "Miranol L2M" (aqueous solution-38% by weight active ingredient) | 0.5 |
| "Ethylan D252" | 0.2 |
| Water | to 100 |

Charge 90 parts by weight of the solution into an aerosol can fitted with a spray type dispensing valve.

Charge the aerosol can containing the solution with 10 parts by weight of a halogenated hydrocarbon aerosol propellant which is a mixture of "Propellant 12" and "Propellant 114" in a 2:3 weight ratio, liquefied under pressure.

To clean a soiled oven, proceed as follows:

(i) Heat the oven to about 200° F.

(ii) Spray the interior, including racks, utensils, trays, etc. all over with the solution dispensed from the aerosol can. The user can see when the surfaces have been completely covered by the sprayed-on solution because the liquid begins to generate foam on contact with the burnt-on organic food deposits.

(iii) Heat the oven to about 475° F. and keep at this temperature for about half an hour.

(iv) Allow oven to cool.

(v) Wipe the surface clean with a damp cloth.

Removable parts such as racks can be rinsed in the sink.

The product is so safe that steps (i) and (iii) can be carried out while food is being cooked in the oven.

EXAMPLE 2. Pump Spray

Make an aqueous solution of the following composition.

| Item | % by weight |
|---|---|
| Sodium bicarbonate | 1.4 |
| Potassium bicarbonate | 16.0 |
| "Miranol L2M" | 0.5 |
| Perfume (di-Pentene) | 1.0 |
| Water | to 100 |

Fill the solution into a bottle fitted with a pump spray applicator head.

To clean a soiled oven, proceed as in Example 1.

EXAMPLE 3. Paste or Gel

Make an aqueous solution as in Example 1 but omitting the "Ethylan D252", or as in Example 2. Mix the solution with a thickening agent such as those known by the trade designations "Kelzan" or "Primal A.S.E. 108", in a proportion sufficient to produce a paste or gel of the desired consistency. The paste or gel may be wiped on to the soilable or soiled surfaces with a cloth, sponge, brush or other suitable applicator.

To clean a soiled oven, proceed as in Example 1 except that in step (ii) the product is applied by wiping on instead of by spraying.

What we claim is:

1. A method of cleaning a surface which is subjected to heat and is soiled, or liable to soiling, by baked-on organic food deposits, which comprises applying to the surface, before and/or after the deposition of the deposits thereon, an aqueous solution of a mixture of 1 to 2% by weight sodium bicarbonate and 14 to 17% by weight potassium bicarbonate in a weight ratio of 1:7 to 1:17 respectively.

2. A composition for use in cleaning a surface which is subjected to heat and is soiled, or liable to soiling, by baked-on organic food deposits, which comprises an aqueous solution containing a mixture of 1 to 2% by weight sodium bicarbonate and 14 to 17% by weight potassium bicarbonate in a weight ratio of 1:7 to 1:17 respectively.

3. A method as set forth in claim 1 in which the weight ratio is approximately 1:11.

4. A method as set forth in claim 1 in which the solution is applied to a soiled surface which is at a temperature of approximately 200° F., the surface is then heated to approximately 475° F., allowed to cool, and the deposits then removed therefrom.

5. A method as set forth in claim 1 wherein the mixture includes a non-ionic, anionic or amphoteric surfactant.

6. A method as set forth in claim 1 wherein the mixture includes a thickening agent.

7. A composition as set forth in claim 2 in which the solution also contains an anionic, nonionic or amphoteric surfactant.

8. A composition as set forth in claim 2 which also includes a thickening agent.

9. A composition as set forth in claim 2 in which the solution contains sodium bicarbonate and potassium bicarbonate in a weight ratio of approximately 1:11.

10. A composition as set forth in claim 7 includes also a liquefied aerosol propellant and contained in a pressurized aerosol dispensing container fitted with a spray discharge valve.

11. A composition as set forth in claim 7 in which the solution contains an amphoteric surfactant of the formula:

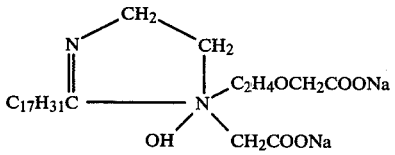

* * * * *